US006056036A

United States Patent [19]

Todd et al.

[11] Patent Number: 6,056,036

[45] **Date of Patent: *May 2, 2000**

[54] CORDLESS SHADE

[75] Inventors: David Todd, Glenville; Robert F. White, Jr., Ganesvoort; Matthew K. Sleasman, Loudonville, all of N.Y.

[73] Assignee: Comfortex Corporation, Watervliet, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/847,264

[22] Filed: May 1, 1997

[51] Int. Cl.[7] ..... A47H 5/00

[52] U.S. Cl. ..... 160/84.05; 160/84.01; 160/84.04; 242/422.5

[58] Field of Search ..... 160/84.01, 84.04, 160/84.05, 170 R, 171 R, 193; 242/422.5, 615

[56] References Cited

U.S. PATENT DOCUMENTS

| | | | |
|---|---|---|---|
| 4,444,242 | 4/1984 | Amsler et al. | 160/172 |
| 4,606,157 | 8/1986 | Esposito | 52/173 R |
| 4,687,041 | 8/1987 | Anderson | 160/84.01 X |
| 4,832,271 | 5/1989 | Geleziunas | 242/55.53 |
| 4,838,333 | 6/1989 | Mottura | 160/305 |
| 5,105,867 | 4/1992 | Coslett | 160/84.1 |
| 5,184,660 | 2/1993 | Jelic | 160/84.01 X |
| 5,279,472 | 1/1994 | Hongo et al. | 242/422.5 |
| 5,307,855 | 5/1994 | Martensson, IV | 160/66 |
| 5,311,729 | 5/1994 | Viaud | 56/341 |
| 5,482,100 | 1/1996 | Kuhar | 160/170 R |
| 5,519,562 | 5/1996 | Argumedo et al. | 360/130.21 |
| 5,531,257 | 7/1996 | Kuhar | 160/168.1 |
| 5,706,876 | 1/1998 | Lysyj | 160/84.05 |
| 5,791,393 | 8/1998 | Judkins | 160/84.05 X |
| 5,799,715 | 9/1998 | Biro et al. | 160/84.04 X |
| 5,868,893 | 2/1999 | Kipper et al. | 156/277 |

*Primary Examiner*—Daniel P. Stodola
*Assistant Examiner*—Bruce A. Lev
*Attorney, Agent, or Firm*—Rader, Fishman & Grauer PLLC

[57] ABSTRACT

A cordless drive mechanism for use in a top rail of a shade having inherent spring characteristics. The drive mechanism includes a constant torque spring assembly, at least two tape spool assemblies, and a brake/clutch mechanism, all interconnected via a shaft. The shaft is driven by at least one spring assembly to drive the tape spool assembly, which retracts a bottom rail of the shade by acting as a reel upon which tape is wound. The brake/clutch assembly locks the shade into a position desired by the user, and applies a braking force to the shaft when the shade is retracting, forcing a virtually constant retraction speed. The constant torque spring assembly is modular, constructed of identical housing pieces, a spring take-up spool and a rolled constant torque spring. More spring assemblies may be added to the drive mechanism for larger and heavier shades. The tape spool assembly includes a tape guide retainer fitted with an angled tape retention wall which prevents slack tape from accumulating with the top rail.

3 Claims, 3 Drawing Sheets

CORDLESS SHADE

FIELD OF THE INVENTION

The present invention is directed to a window shade adjustment apparatus. More particularly, the present invention is directed to a cordless window shade.

BACKGROUND OF THE INVENTION

Shades are used in a wide variety of applications to regulate the amount of light entering a given location and to enhance the overall appearance of the location in which the shades are placed. Shades normally employ several strings which are vertically placed through the shade and are bundled into a single shade cord. The shade cord is used to raise or lower the shade in conjunction with a shade positioning apparatus.

Conventional cellular or pleated shades utilize cord locks or a clutch system to raise, lower and position a shade. With the cord lock mechanism, cords run up through the folded fabric, across the inside of a head rail and exit through a cord lock mechanism. Based on the width of a given shade, there can be no fewer than two and up to six or more cords coming out of the lock mechanism. In systems which utilize a clutch system, a continuous loop cord, not unlike the system use in raising and lowering a flag on a flagpole, is used. While shade positioning apparatuses allow for the desired positioning of the shades, they suffer from many drawbacks.

First, the mere presence of a cord increases the danger of a child getting caught in or strangled by the exposed control cord. Second, excess cord usually is arranged around a wall-mounted cup hook or a cord cleat after the shade is adjusted. Wrapping the cord keeps it from hanging down to the floor but takes extra time and effort on the part of the person adjusting the shade. If left alone, the cords puddle on the floor, looking unsightly and leaving the window area unsafe to children and adults alike. Third, cords hanging from the lock or clutch mechanism are often perceived as aesthetically displeasing and detract from the decorative function of the shade. Fourth, ordinary shades with lock mechanisms regularly go out of alignment, making the bottom rail uneven. Finally, many of the shade positioning apparatuses utilizing cords frequently tangle or otherwise twist the shade cord after continued use of the apparatus.

Common roller shades are known which operate in the absence of a cord. These roller shades include a wound torsion-spring retraction mechanism in combination with a catch mechanism mounted along a take-up roller onto which the shade rolls. In operation, a roller shade is pulled down manually to a desired location, where it locks and stays until the shade is released. To release the shade, an operator tugs along a bottom rail of the shade, extending the shade sufficiently to disengage an internal clutch within the catch mechanism of the shade. When the clutch is disengaged, the shade then retracts under its power, using the torsion-spring driven retraction mechanism. Known roller shades are only operable with flat shade material which rolls up neatly into a confined location. As the shade retracts, the operator must keep some downward force on the shade to prevent violent shade retraction which may cause injury or damage to the shade.

Cellular, pleated or multi-cellular window covering treatments have superior light-blocking, insulation, and aesthetic properties over conventional roller shades. However, physical properties of pleated, cellular, and multi-cellular shades have heretofore prevented their use with roller shade mechanisms. In particular, a cellular or pleated shade is itself a spring, tending to return to a collapsed condition at the top of a window opening where it is usually stored. When fully retracted at the top of a window opening, the weight of the cellular shade still requires supplementary retention, because in that fully collapsed condition of the cells, the cellular shade has no remaining upward bias force of its own due to its own spring characteristics when retracted. On the other hand, when a cellular shade is fully extended to cover a window opening, it exerts a maximum upward bias force due to its own spring characteristics. Additionally, conventional roller shades utilize traditional torsional coil springs which also provide maximum upward bias force when fully extended. In order to support the weight of a fully retracted shade, a torsional coil spring would have to be pre-loaded, which would greatly increase the force of the spring on the shade when it is fully extended. A combination of the upward bias force of a shade demonstrating its own inherent spring characteristics and the upward bias force of a traditional torsional coil spring at maximum extension would create excessive force and acceleration in retraction of the shade, causing danger of striking a person or of damaging the shade itself when it reaches the top of the stroke.

In addition, the large variation among window areas covered by pleated, cellular or multi-cellular shades leads to a large variation in the weight of the shade itself. Conventional torsional coil spring shade retraction mechanisms require more torsional spring length as the weight of the shade increases. For long but relatively narrow window openings, the take-up roller of a conventional roller shade retraction mechanism does not have enough length along the roller for the required torsional spring length. Therefore, a need exists for a roller spring mechanism which may be utilized with pleated, cellular or multi-cellular shades to eliminate the requirement of a cord in a lock or clutch mechanism, to limit the velocity and force of upward travel of the shade as it retracts, and to use with heavier shades in narrower window openings.

SUMMARY OF THE INVENTION

The present invention is directed to a cordless window shade which offers an alternative to cord-operated shades, with added safety and improved aesthetics. The shade utilizes a retraction mechanism which includes a constant torque spring system for lift, and a clutch/brake system for positioning and retraction speed control. A shaft is driven by the constant torque spring system, the speed and force of travel of which is regulated by the brake/clutch system. A tape spool system attached to the shaft provides the means by which the shade is raised or lowered. The tape spool system includes a length of tape determined by the length of the shade, a tape spool, a tape guide, a tape guide retainer and a bottom plug. The tape spool, also driven by the shaft, serves as a reel upon which the tape winds. The tape is connected at one end to the tape spool and at the other end to a bottom rail at the bottom of the shade via the bottom plug, which is threaded onto the tape at a fixed location and inserted into pre-drilled holes in the bottom rail. The tape guide serves as a bearing support for the tape spool, and also as a guide for the tape to direct it through an aperture in the top rail. The tape guide retainer is secured to the tape guide at one end. At its other end, the tape guide retainer is provided with a curved finger which is resiliently biased against a portion of the external circumference of the tape spool, thereby preventing the tape from coming unraveled from the tape spool. The tape guide retainer is further provided along an intermediate portion with an angled tape retention wall located substantially vertically above the aperture in the top guide through which the tape passes. If a user pushes the shade up rather than operating it, slack tape would normally be forced up through the tape guide retainer and into the upper housing area of the top rail, presenting the danger of the tape coming off of the spool or of the tape being caught within the spring mechanism. The angled retention wall traps the tape within the shade and prevents slack tape from entering and accumulating within the top rail away from the tape spool.

The roller drive of the present invention operates no differently than the prior art roller shades. By simply holding the bottom rail in the center and gently pulling downward, the shade can be extended to the desired length. The brake/clutch system features one way operation that locks the shade in position when manually pulled to the desired location. To raise the shade, a gentle tug on the bottom rail will disengage an internal clutch within the brake/clutch mechanism of the shade, thereby allowing the spring system to drive the tape spool system, causing the tape spool to reel in the tape within the shade, thereby raising the shade to a desired height. The spring system produces virtually constant torque on the shaft throughout its operational cycle. However, the retraction speed of the shade is regulated by the centrifugal braking system which applies increasing braking force along the shaft as its rotational velocity increases, resulting in virtually constant retraction speed of the tape onto the tape spool. Further, the spring system may be pre-loaded to support the weight of the fully retracted shade, with the magnitude of the pre-load dependent upon the size of the shade.

The present invention thus provides a cord-free, child-safe alternative lift system for existing pleated, honeycombed cell or multi-cellular shades currently on the market. The constant velocity spring retention system eliminates any possibility of injury due to exposed lift chords, and prevents violent retraction of the shade due to the combined forces of the internal spring mechanism and the inherent spring characteristics of the shade material. The tape guide retainer of the present invention further prevents fouling of the tape spool and prevents the tape from becoming unraveled from the tape spool. The compact nature of the retraction mechanism and its modularity enable use with shades of all sizes, and especially with narrow, heavier shades with which conventional torsional coil springs are insufficient.

DETAILED DESCRIPTION OF A PREFERRED EMBODIMENT

Figure 1:
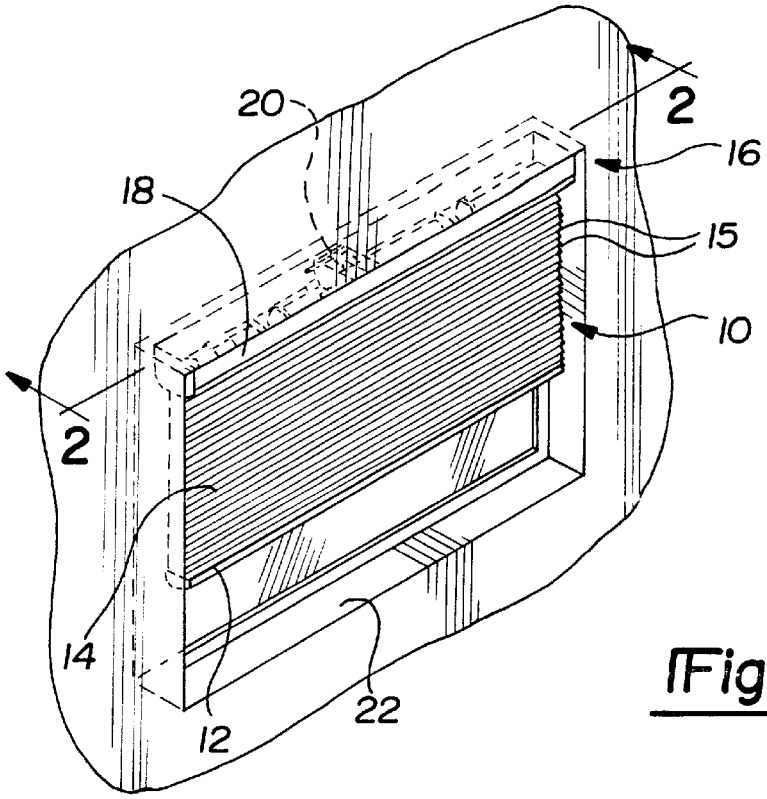
FIG. 1 is an environmental view of a cordless window shade of the present invention.

The roller shade of the present invention is demonstrated in FIG. 1. Shade assembly 10 includes a lower rail assembly 12, a cellular shade 14, and an upper rail assembly 16. Upper rail assembly 16 further includes a decorative top rail 18 and a drive mechanism 20. As seen in FIG. 1, shade assembly 10 is mounted within window frame 22 such that the drive mechanism 20 is hidden within decorative top rail 18. Typically, shade 14 is attached to lower rail assembly 12 and upper rail assembly 16 with fabric stiffeners (not shown) which are inserted within terminal cells and extend the entire width of shade 14. Because shade 14 includes cells, pleats or folds 15, shade 14 is itself a spring.

Figures 2, 4, 5:
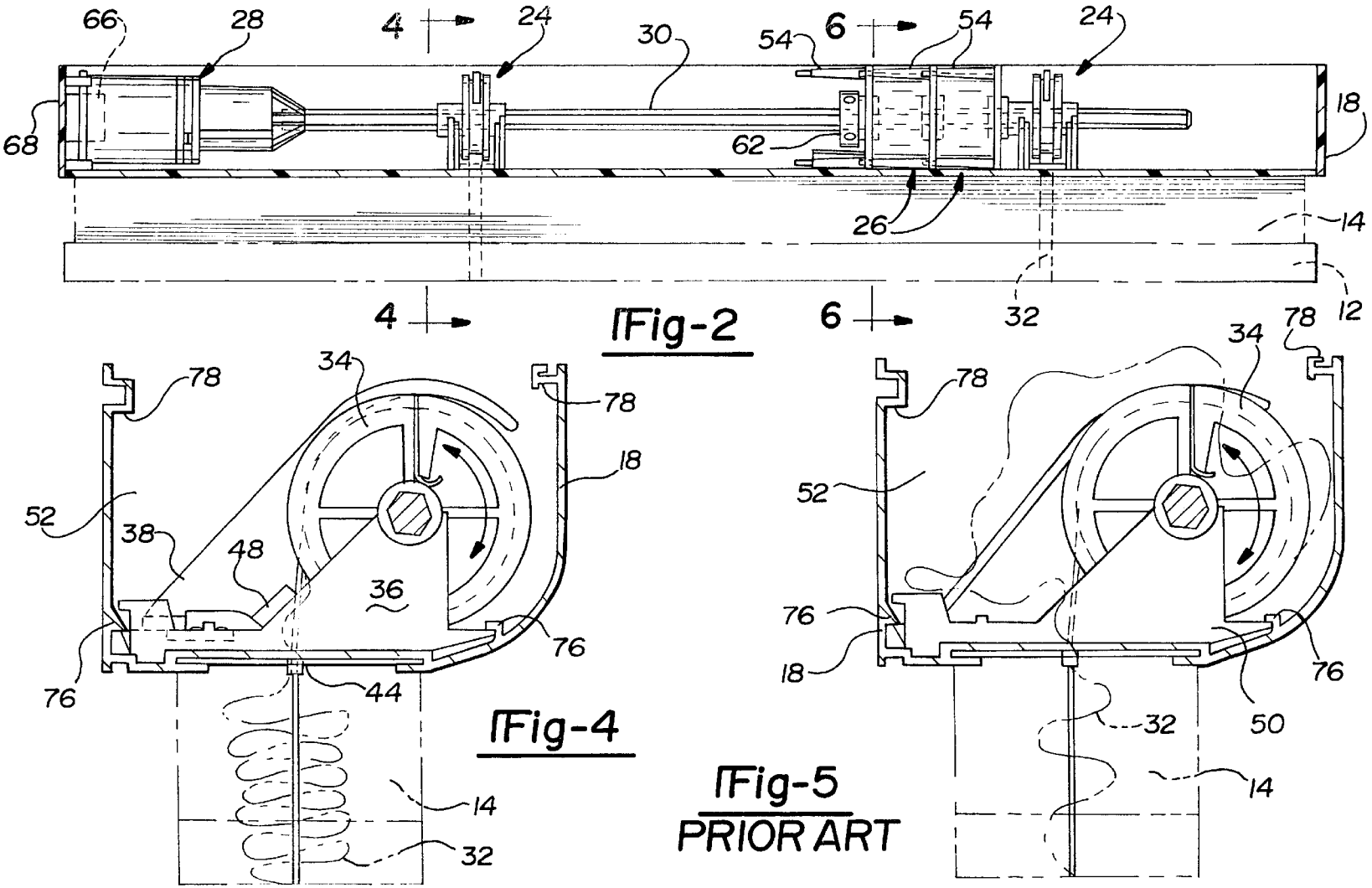
Fig-5 PRIOR ART
FIG. 2 is a partial cross-sectional view taken substantially along lines 2—2 of FIG. 1.
FIG. 4 is a cross-sectional view of a spool mechanism of the present invention taken along line 4—4 of FIG. 2.
FIG. 5 is a cross-sectional view of a prior art spool mechanism.

Drive mechanism 20 is further illustrated in FIG. 2. When assembled, drive mechanism 20 is housed within decorative top rail 18. According to the present invention, drive mechanism 20 includes at least two spool assemblies 24, at least one modular spring assembly 26 (two spring assemblies 26 are shown in FIG. 2) and a brake/clutch mechanism 28. Spool assemblies 24 are connected and driven by spring assemblies 26 via shaft 30, which is also interconnected with brake/clutch mechanism 28. Brake/clutch mechanism 28 attaches to end cap 68 on connector 66, while spool assemblies 24 and spring assemblies 26 are sized to fit snugly within top rail 18, thus securing drive mechanism 20 within top rail 18. The length of shaft 30 may be adjusted as the width of shade 14 increases or decreases. Similarly, the number of spool assemblies 24 and modular spring assemblies 26 may be adjusted based upon the width of shade 14. As shade 14 becomes longer, and therefore heavier, more spools assemblies 24 and spring assemblies 26 will be required. A pre-load of varying magnitude may be applied to spring assemblies 26 in order to support the weight of shade 14 when it is fully retracted to a position at the top of the window opening. The position of spring assemblies 26 relative to spool assemblies 24 is maintained through the use of spacers 62 placed along shaft 30.

Figure 3:
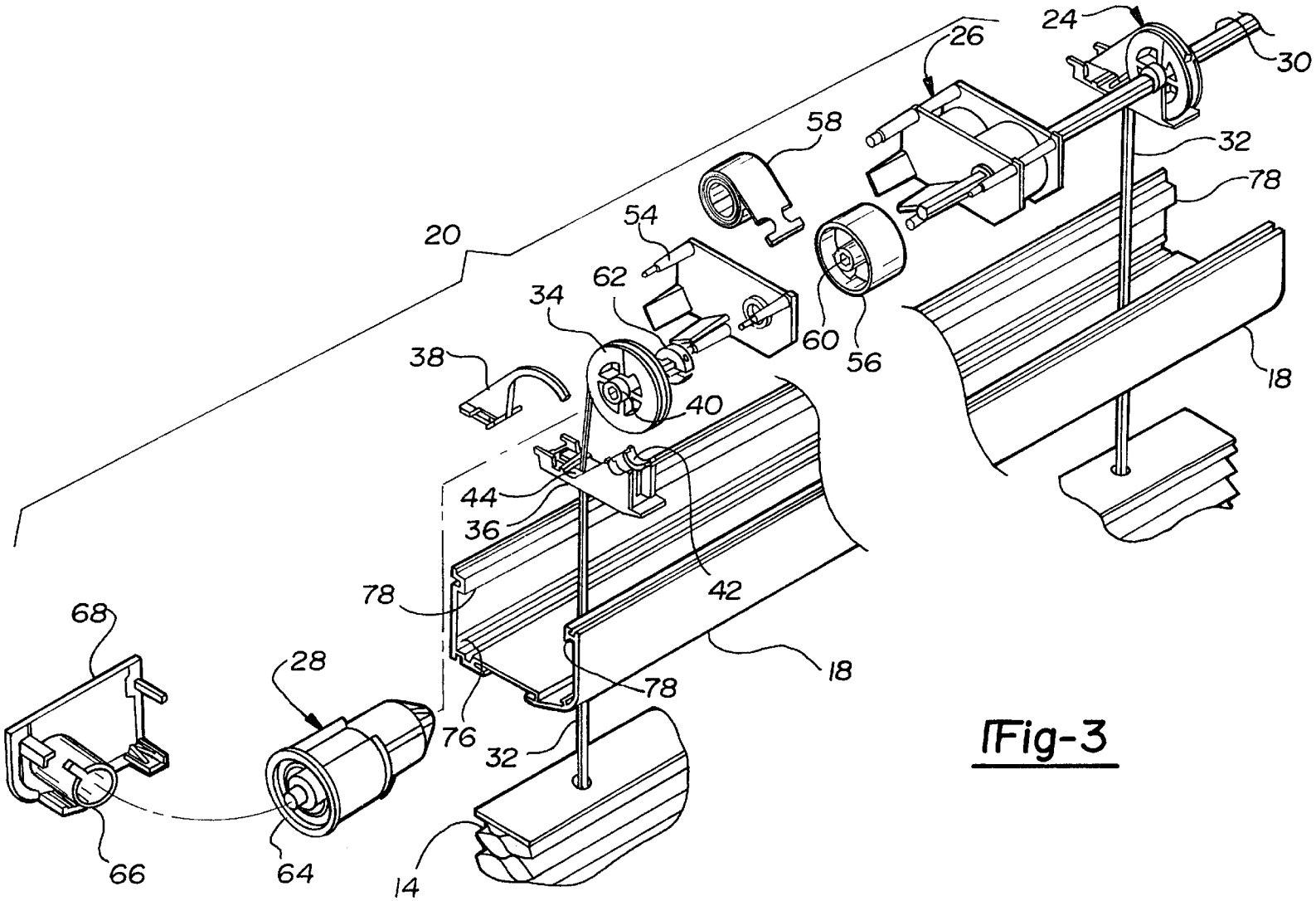
FIG. 3 is an exploded view of the drive system of FIG. 2

The individual components of drive assembly 20 are shown in FIG. 3. Spool assembly 24 attached to shaft 30 includes tape 32, the length of which is determined by the length of shade 14, a tape spool 34, a tape guide 36, and a tape guide retainer 38. Tape spool 34 is driven by shaft 30 and serves as a reel for tape 32 to wind upon. Tape 32 is connected at one end to tape spool 34 and at the other end to lower rail assembly 12 through pre-drilled holes (not shown) in lower rail assembly 12. Tape spool 34 includes a hub 40 which is received upon bearing portion 42 of tape guide 36. Tape guide 36 therefore serves as a bearing support for tape spool 34, and also as a guide for tape 32. Tape guide 36 includes an aperture 44 through which tape 32 passes. An aligned aperture (not shown) is provided in top rail 18. Aperture 44 in tape guide 36 therefore guides tape 32 into proper position with respect to shade 14 and spool 34. Tape guide retainer 38 is secured to tape guide 36 at one end. At its other end, tape guide retainer is provided with a curved finger 46 which is resiliently biased against a portion of the external circumference of tape spool 34. Resilient finger 46, because of its bias against tape spool 34, prevents tape 32 from becoming unraveled from tape spool 34.

As shown in FIG. 5, prior art tape guide retainers do not include an angled tape retention wall, though they may include resilient fingers for holding tape on a tape spool. With prior art tape guide retainers, if a user pushed the shade up rather than activating the shaft and spool, tape 32 would normally be forced up through the prior art tape guide retainer 50 and into the upper housing area 52 within top rail 18. As tape 32 is forced out of shade 14, it becomes unraveled from tape spool 34 and presents a danger of becoming fouled with the spool assembly or the drive mechanism. As shown in FIG. 4, angled retention wall 48 positioned substantially vertically above aperture 44 on tape guide retainer 38 traps tape 32. Because of the position of angled retention wall 48, tape 32 is forced into contact with angled retention wall 48, which prevents tape 32 from being forced up through tape guide 36 into area 52 within the decorative top rail 18. Tape 32 is therefore in no danger of unraveling from spool 34. Moreover, angled retention wall 48 is upwardly angled towards tape spool 34. Positioned in this way, angled retention wall 48 does not interfere with tape 32 during normal operation of spool assembly 24.

Returning to FIG. 2, drive mechanism 20 includes at least one spring assembly 26. Spring assembly 26 includes housings 54, a spring take-up spool 56 and a constant torque spring 58. Housings 54 are modular in design such that two identical housings 54 snap together to enclose one constant torque spring 58 and one spring take-up spool 56. In order to add a second spring take-up spool and a second constant torque spring, only one additional housing 54 need be provided. Two spring assemblies 26 are shown in FIGS. 2 and 3; however, more or fewer spring assemblies may be necessary to retract the weight of shade 14 depending upon the size of shade 14. Spring assemblies 26 are therefore modular, allowing stacking of spring assemblies to achieve torque necessary to retract any size shade 14. Because spring assembly 26 utilizes a constant torque spring 58, the torque produced by the springs remains virtually constant throughout its operational cycle. Inexpensive rolled constant-torque springs such as spring 58 are well known for use in other applications. However, rolled springs have not been used in window shade drive assemblies because the diameter of the spring is large relative to an equivalent torsional coil spring, requiring greater space within which to house the spring. The present application, however, supplies ample space within which to house the spring. Additionally, because the spring assemblies 26 are modular, any required additional force, eg. to raise a longer shade, may be applied to shaft 30 merely by increasing the number of spring assemblies 26 attached thereto. Thus the axial dimension, rather than the diametrical dimension, increases with increased spring capacity.

Figure 6:
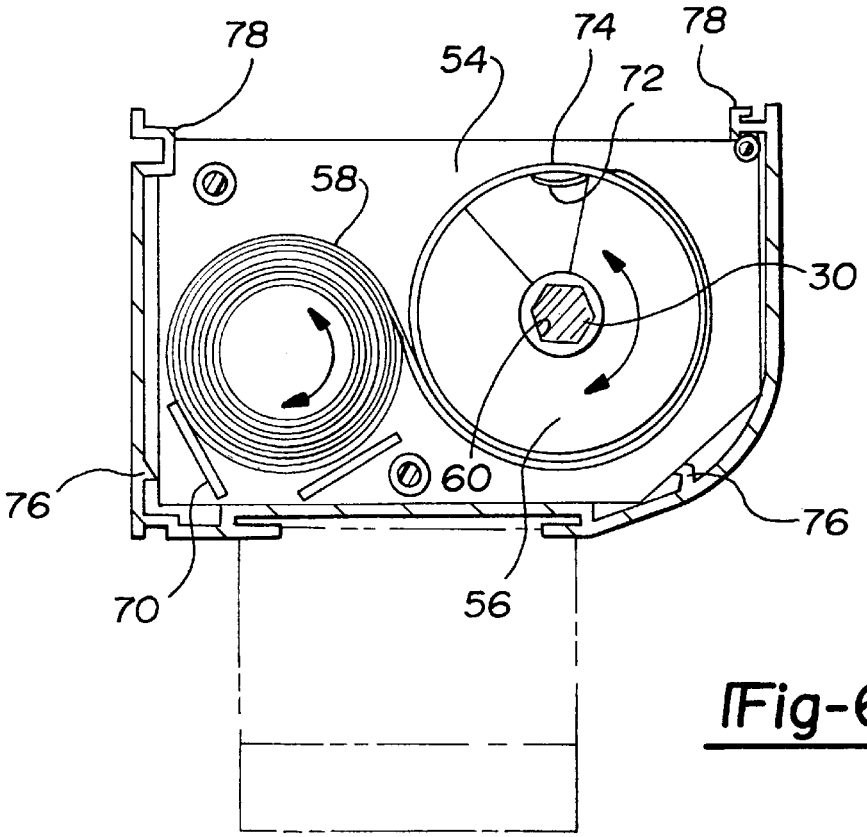
FIG. 6 is a cross-sectional view of a spring mechanism of the present invention taken along line 6—6 of FIG. 2.

As seen in FIG. 6, constant torque spring 58 lies freely within housing 54 and rests upon shelves 70 formed integrally with housing 54. Spring 58 includes an end 72 which is received within opening 74 of spring take-up spool 56. As shaft 30 turns in a counter-clockwise direction, spring 58 is drawn upon take-up spool 56 (as a result of the driving relationship between the hexogonal shaft 30 and hexogonal hole 60 in spool 56), thereby exerting a force along shaft 30 in a clockwise direction. When one-way operation of brake/clutch mechanism 28 is released, the clockwise force exerted upon shaft 30 by spring 58 causes shaft 30 to rotate in a clockwise direction, allowing spring 58 to wind back upon itself. Spring 58 is pre-loaded depending upon the size of the shade to apply enough tension to shaft 30 to support shade 14 when it is in a fully retracted position.

Brake/clutch mechanism 28 features one-way operation that locks shade 14 in position when manually pulled to the desired location. Brake/clutch system allows shade 14 to retract when shade 14 is pulled a predetermined additional amount and then released. When shade 14 is released, its retraction speed is regulated by a centrifugal braking system contained within brake/clutch system 28, which applies increasing braking force as the rotational velocity of shaft 30 increases, resulting in a constant retraction speed of shade 14.

Brake/clutch systems such as the one described are well known in the art. In the preferred embodiment, the present invention utilizes a Yeil brand ratchet unit as its brake/clutch mechanism 28. Brake/clutch mechanism 28 includes a modified end cap 64 which is received upon a connector 66 integrally formed with end cap 68. Drive mechanism 20 is thereby anchored within decorative top rail 18. As best seen in FIGS. 3, 4 and 6, top rail 18 includes projections 76 and ledges 78, under which spool assembly 24 and spring assembly 26 frictionally engage. Projections 76 prevent vertical movement of drive assembly 20 under normal operating circumstances, thus fixing the position of drive assembly 20 within top rail 18.

Operation of the present invention may be demonstrated with reference to FIGS. 2 and 3. As a user pulls shade 14 downwardly and extends it to a desired position, tape 32 is unrolled from spool 34 to a length equal to the desired length of shade 14. As shade 14 is pulled to its desired position, constant torque spring 58 is wound upon spring take-up spool 56. Though constant torque spring 58 exerts the force along shaft 30, one-way operation of brake/clutch 28 prevents shade 14 from retracting and locks shade 14 into the position desired by the user. Brake/clutch 28 utilizes a conventional spring-loaded cam pin (not shown) which locks into a steel guide (not shown) within the clutch when the shade pulled to a desired length. If shade 14 is raised or pushed upwardly without releasing the locked brake/clutch mechanism 28, angled retention wall 48 traps slack tape 32 within shade 14. However, if shade 14 is pulled downwardly an additional predetermined amount, the spring-loaded cam pin is released from the steel guide, allowing retraction of the shade. The rotational velocity of shaft 30 driven by spring assembly 26 is sufficient to prevent the cam pin from seating unless the user manually retards upward movement of the shade. When one-way operation of brake/clutch mechanism 28 is released and upward movement of the shade is not restrained, force exerted by constant torque spring 58 along shaft 30 causes shaft 30 to rotate, which causes tape spool 34 to begin reeling in tape 32, which in turn causes shade 14 to rise. Shaft 30 is connected to a rotor (not shown) through a planetary gear (not shown), creating a speed increase by the rotor. Brake shoes (not shown) on the rotar are spun into an extended position where they engage against a stationary brake housing (not shown), thereby applying increasing braking force as the rotational velocity of shaft 30 increases. In combination, the force exerted by constant torque spring 58 upon shaft 30 and the centrifugal braking exerted in an opposite rotational direction along shaft 30 result in a constant and controlled retraction speed of shade 14.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. In a roller type retraction system adapted for use in driving a shade having inherent spring properties tending to retract the shade to a stowed position from a deployed position, a spool assembly including a rotatably mounted spool having its rotational axis oriented parallel to the plane of the deployed shade and having a perimeter from which a shade supporting tape is unwound during shade deployment and onto which it is rewound during shade retraction, and a tape access aperture through which the tape passes during winding and unwinding, the spool being positioned relative to the tape access aperture such that the tape extends in a substantially vertical path from said tape access aperture to its point of tangency with the spool perimeter, an improved tape guiding means which comprises:

a tape guide retainer having a base portion and an upper portion, said upper portion including a finger curved to resiliently engage a partial outer circumference of the spool to prevent the tape from unraveling off the spool; and said base portion including the tape access aperture and a deflection plate located immediately adjacent to said vertical path and between said point of tangency and said access aperture, said deflection plate being also located so that said vertical path passes between said deflection plate and the spool, said deflection plate being inwardly angled toward the spool so that any slack tape which may be formed above said access aperture during rewinding thereof will be deflected toward the spool, to thereby prevent the tape from fouling the spool assembly.

2. In a cordless roller type shade retraction system for a shade having inherent spring properties tending to retract the shade to a stored position from a deployed position, and having a head rail assembly including a rotatable shaft and spool assembly on which a shade-retracting tape is wound, an improved shaft-rotating drive means for causing said shaft and spool assembly to wind up the tape, comprising:

a constant torque roll spring extending between a first coiled portion adjacent to the shaft and a second portion having an end fixed to a spool mounted on the shaft for rotation therewith;

said spring being attached to said spool such that when said spool is driven by said shaft in a first direction during deployment of the shade, said spring rolls onto said spool from said first coiled portion and provides a biasing force on said shaft tending to rotate the shaft in a shade-retracting direction which is opposite to said first direction;

at least one spring housing in which said shaft is rotatably mounted, said housing having mounting means for fixedly securing it within the head rail assembly and coil-positioning means for accommodating and positioning said first coiled portion of said roll spring during transfer of portions of said spring between said coiled portion and said spool;

the drive means being modular to permit similar drive units to be added to the head rail assembly when additional spring force is required, said spring housing being axially slidable along the shaft and axially stackable with adjacent spring housings and snap together.

3. The improved shaft-rotating drive means of claim 2, wherein a pre-load is applied to said spring in said shade-retracting direction to support the shade in the fully-retracted stored position.

* * * * *